US009833873B2

(12) United States Patent
Xue et al.

(10) Patent No.: US 9,833,873 B2
(45) Date of Patent: Dec. 5, 2017

(54) WHEEL DEBURRING DEVICE AND DEBURRING METHOD

(71) Applicant: CITIC Dicastal CO., LTD, Qinhuangdao (CN)

(72) Inventors: Bowen Xue, Qinhuangdao (CN); Jiandong Guo, Qinhuangdao (CN); Yongning Wang, Qinhuangdao (CN); Zhihua Zhu, Qinhuangdao (CN); Changhai Li, Qinhuangdao (CN); Binyu Xiong, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 38 days.

(21) Appl. No.: 14/981,678

(22) Filed: Dec. 28, 2015

(65) Prior Publication Data

US 2016/0184958 A1 Jun. 30, 2016

(30) Foreign Application Priority Data

Dec. 29, 2014 (CN) ..... 2014 1 0833693

(51) Int. Cl.
*B24B 9/04* (2006.01)
*B24B 29/00* (2006.01)

(52) U.S. Cl.
CPC ..... *B24B 29/005* (2013.01)

(58) Field of Classification Search
CPC ..... B24B 9/04; B24B 29/00; B24B 29/005
USPC ..... 451/49, 283, 246, 249, 254, 258, 63
See application file for complete search history.

(56) References Cited

U.S. PATENT DOCUMENTS

| | | | | |
|---|---|---|---|---|
| 3,077,060 | A * | 2/1963 | Cooper | B24B 5/366 451/254 |
| 4,009,409 | A * | 2/1977 | Buescher | H01J 29/04 313/337 |
| 6,217,424 | B1 * | 4/2001 | Stephens | B24B 5/44 451/254 |
| 6,722,961 | B2 * | 4/2004 | Solanellas | B23Q 1/54 451/140 |
| 2002/0142708 | A1 * | 10/2002 | Bilinovich, Sr. | B24B 5/44 451/49 |

* cited by examiner

*Primary Examiner* — Robert Rose
(74) *Attorney, Agent, or Firm* — Hamre, Schumann, Mueller & Larson, P.C.

(57) ABSTRACT

The present invention provides a wheel deburring device, consisting of a frame, a motor, a guide rail, a swing plate, a cylinder, a servo electric cylinder and a hairbrush and the like. When in use, the device provided by the present invention can adjust the angle of the hairbrush according to the shape of the back cavity of the wheel spoke to adapt to hubs of any style, and the deburring effect is very ideal; and meanwhile, the device has the characteristics of high degree of automation, advanced process, safe and stable performance, etc.

4 Claims, 4 Drawing Sheets

WHEEL DEBURRING DEVICE AND DEBURRING METHOD

TECHNICAL FIELD

The present invention relates to the field of manufacture of aluminum alloy wheels, and particularly, to a self-adapting wheel deburring device.

BACKGROUND ART

In a production process of automobile aluminum alloy hubs, removal of burrs on back cavities after machining is a very important procedure, and the effect thereof directly influences subsequent coating effect. Due to the diversity of style types of hub back cavities, the traditional deburring method cannot achieve an ideal effect at all, and in order to meet the deburring demands of a variety of back cavities of wheel spokes, only the angle of a hairbrush can be adjusted to adapt to the styles thereof. However, no deburring device has this function at present.

INVENTION CONTENTS

The purpose of the present invention is to provide a wheel deburring device, which can adjust the angle of a hairbrush according to the shape of a back cavity of a wheel spoke to adapt to hubs of any styles.

To fulfill the aforementioned purpose, the technical solution of the present invention is as follows: a self-adapting wheel deburring device is composed of a frame, a medium plate, a synchronous guide rail, a gear rack, a left sliding plate, a left shaft, a left roller, a right roller, a right shaft, a right sliding plate, a servo motor, a clamping cylinder, a gear, a lifting cylinder, a lower plate, a guide post, a guide sleeve, a lifting plate, a translation guide rail, a translation bottom plate, an upper plate, a swing plate I, a motor, a swing plate II, a driving shaft, a hairbrush, a servo electric cylinder I, an upright post, a servo electric cylinder II and a servo electric cylinder III. The synchronous guide rail above which the left sliding plate and the right sliding plate are fixed is fixed above the medium plate; the gear racks are fixed below both of the left sliding plate and the right sliding plate, and two left shafts, left rollers, right shafts and right rollers are respectively fixed above; the servo motor is installed below the right sliding plate; an output end of the clamping cylinder fixed on the right side of the frame is connected with the right sliding plate; and the gears engaged with the gear racks are also installed above the medium plate to achieve the synchronous movement of the left sliding plate and the right sliding plate.

Two lifting cylinders are fixed below the lower plate, and the output ends thereof are hinged with the lifting plate fixed with four guide sleeves; the guide posts are fixed between the upper plate and the lower plate and matched with the guide sleeves; the translation bottom plate above which the upright post is fixed is fixed above the lifting plate by the translation guide rail; the swing plate I is hinged and fixed above the translation bottom plate; both ends of the servo electric cylinder II are respectively hinged with the swing plate I and the translation bottom plate; the swing plate II is hinged with the swing plate I; both ends of the servo electric cylinder I are respectively hinged with the swing plate II and the upright post; the motor is fixed below the swing plate II, and the output end thereof is connected with the hairbrush by the driving shaft; and the output end of the servo electric cylinder III installed above the lifting plate is connected with the upright post.

In one aspect of the present invention, a wheel deburring device is provided, characterized in that the device includes a self-adapting burr brushing machine and a wheel fixing device, and the self-adapting burr brushing machine includes a hairbrush which is connected to a servo electric cylinder by a swing plate.

In a preferred aspect of the present invention, a self-adapting wheel deburring device is provided, consisting of a frame (1), a medium plate (2), a synchronous guide rail (3), a gear rack (4), a left sliding plate (5), a left shaft (6), a left roller (7), a right roller (8), a right shaft (9), a right sliding plate (10), a servo motor (11), a clamping cylinder (12), a gear (13), a lifting cylinder (14), a lower plate (15), a guide post (16), a guide sleeve (17), a lifting plate (18), a translation guide rail (19), a translation bottom plate (20), an upper plate (21), a swing plate I (22), a motor (23), a swing plate II (24), a driving shaft (25), a hairbrush (26), a servo electric cylinder I (27), an upright post (28), a servo electric cylinder II (29) and a servo electric cylinder III (30); wherein the frame (1), the medium plate (2), the synchronous guide rail (3), the gear rack (4), the left sliding plate (5), the left shaft (6), the left roller (7), the right roller (8), the right shaft (9), the right sliding plate (10), the servo motor (11), the clamping cylinder (12) and the gear (13) form a burr brushing part, the burr brushing part is installed on a wheel conveying belt, and the advance direction of the wheel conveying belt is perpendicular to a connecting line of the left roller (7) and the right roller (8); the lifting cylinder (14), the lower plate (15), the guide post (16), the guide sleeve (17), the lifting plate (18), the translation guide rail (19), the translation bottom plate (20), the upper plate (21), the swing plate I (22), the motor (23), the swing plate II (24), the driving shaft (25), the hairbrush (26), the servo electric cylinder I (27), the upright post (28), the servo electric cylinder II (29) and the servo electric cylinder III (30) form a clamping and rotating part, and the clamping and rotating part is installed in the middle of the conveying belt and below a wheel; the synchronous guide rail (3) above which the left sliding plate (5) and the right sliding plate (10) are fixed is fixed above the medium plate (2); the gear racks (4) are fixed below both of the left sliding plate (5) and the right sliding plate (10), and two left shafts (6), left rollers (7), right shafts (9) and right rollers (8) are respectively fixed above; the servo motor (11) is installed below the right sliding plate (10); an output end of the clamping cylinder (12) fixed on the right side of the frame (1) is connected with the right sliding plate (10); the gears (13) engaged with the gear racks (4) are also installed above the medium plate (2) to achieve the synchronous movement of the left sliding plate (5) and the right sliding plate (10); two lifting cylinders (14) are fixed below the lower plate (15), and the output ends thereof are hinged with the lifting plate (18) fixed with four guide sleeves (17); the guide posts (16) are fixed between the lower plate (15) and the upper plate (21) and matched with the guide sleeves (17); a translation bottom plate (20) above which the upright post (28) is fixed is fixed above the lifting plate (18) by the translation guide rail (19); the swing plate I (22) is hinged and fixed above the translation bottom plate (20); both ends of the servo electric cylinder II (29) are respectively hinged with the swing plate I (22) and the translation bottom plate (20); the swing plate II (24) is hinged with the swing plate I (22); both ends of the servo electric cylinder I (27) are respectively hinged with the swing plate II (24) and the upright post (28); the motor (23)

is fixed below the swing plate II (24), and the output end thereof is connected with the hairbrush (26) by the driving shaft (25); and the output end of the servo electric cylinder III (30) installed above the lifting plate (18) is connected with the upright post (28).

In actual use, the wheel is positioned on a roller way by a sensor, the clamping cylinder drives the two left rollers and right rollers to clamp the wheel by the gears and gear racks, and the servo motor drives the wheel to rotate at a clamping state; the two lifting cylinders lift the hairbrush, and the motor drives the hairbrush to rotate; and the hairbrush can be adjusted to any angle by the servo electric cylinder I and the servo electric cylinder II, in order to adapt to the shape of the back cavity of the wheel spoke, and the servo electric cylinder III can adjust the stroke of the hairbrush within a small range.

When in use, the device provided by the present invention can adjust the angle of the hairbrush according to the shape of the back cavity of the wheel spoke to adapt to hubs of any styles, and the deburring effect is very ideal; and meanwhile, the device has the characteristics of high degree of automation, advanced process, safe and stable performance, etc.

Figure 1:
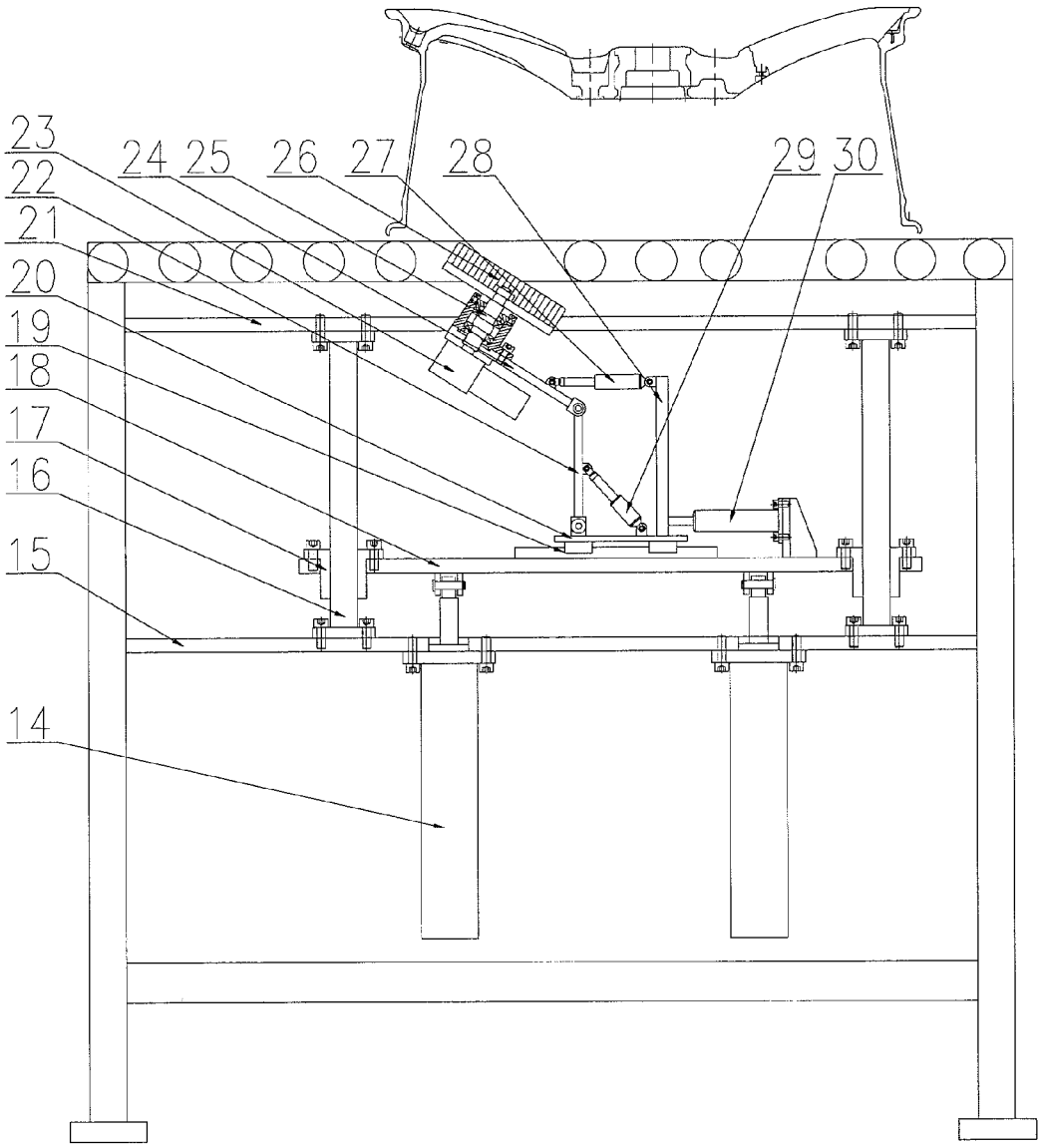
FIG. 1 is a front view of a burr brushing part of a self-adapting wheel deburring device in the present invention.
Figure 2:
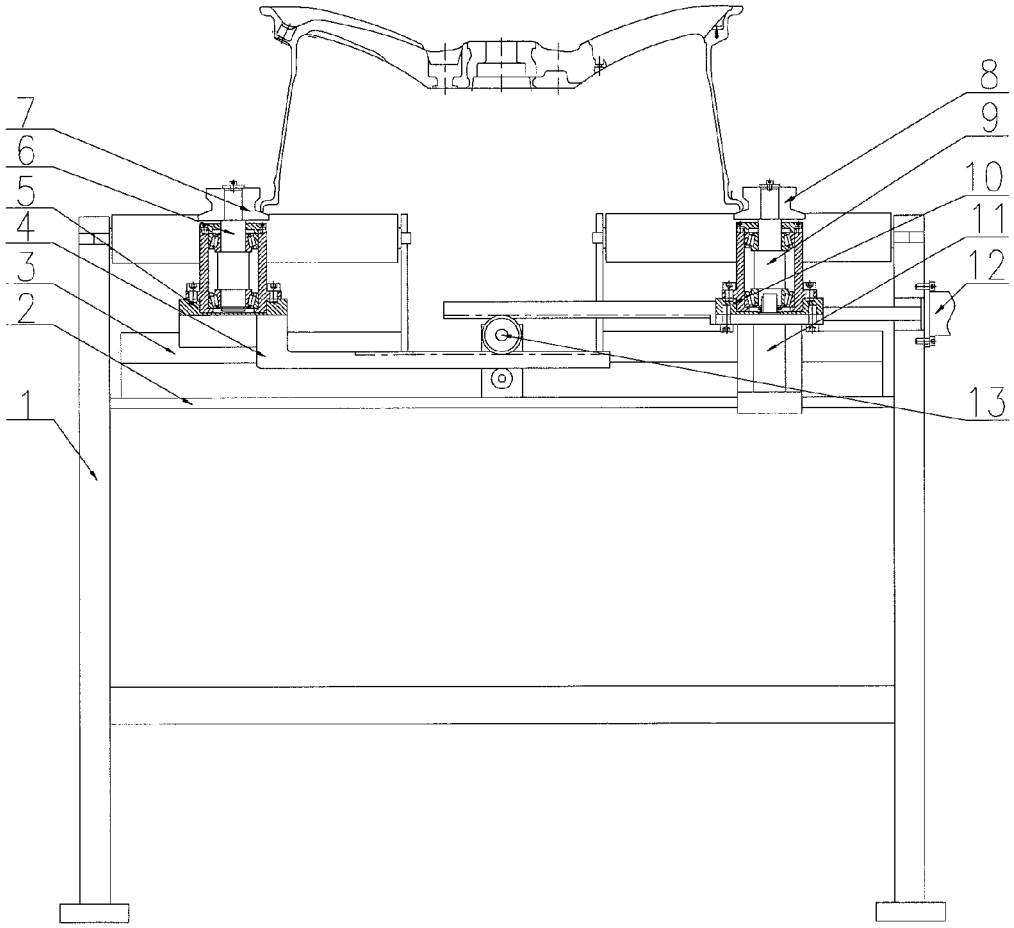
FIG. 2 is a front view of a clamping and rotating part of a self-adapting wheel deburring device in the present invention.
Figure 3:
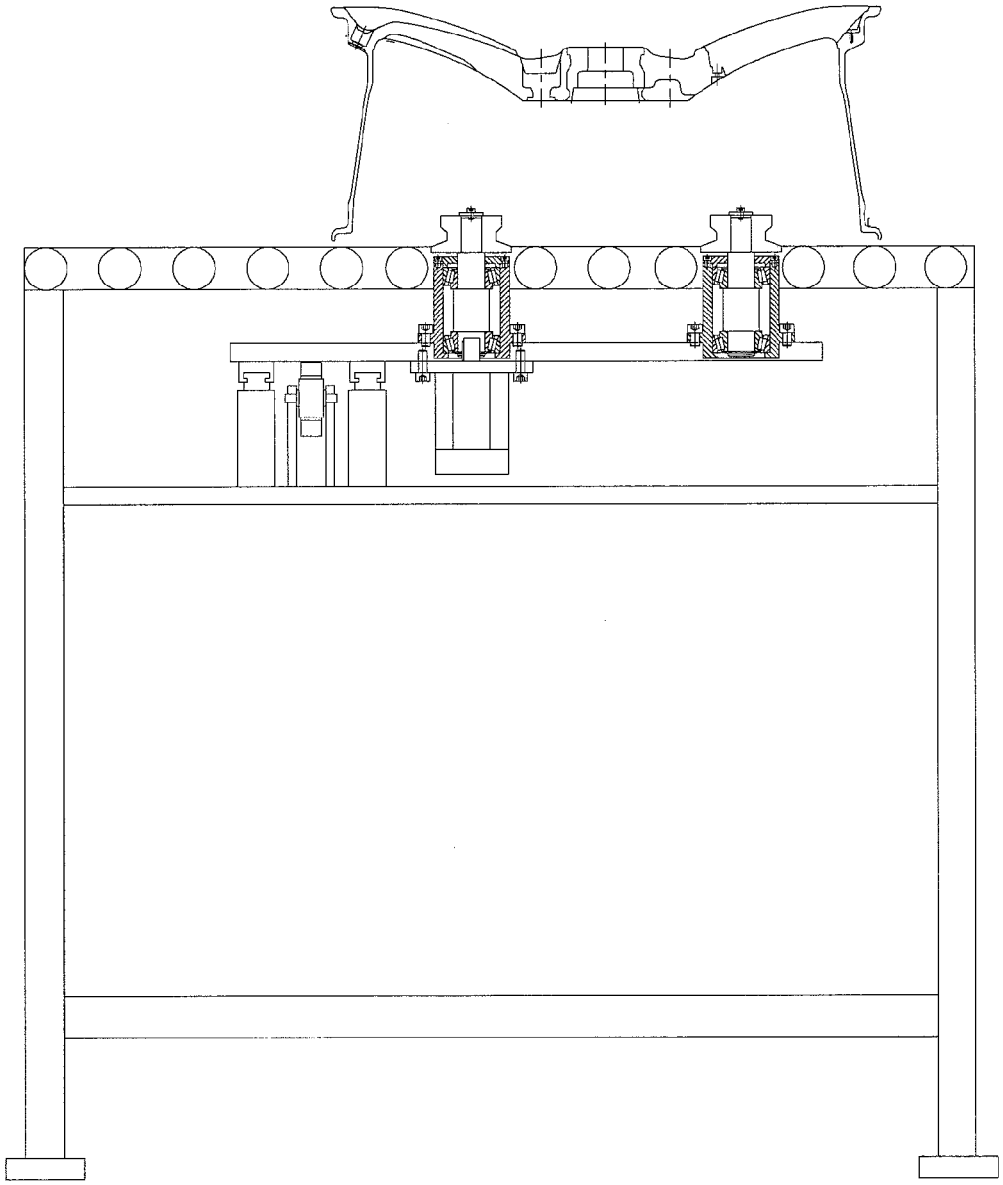
FIG. 3 is a left view of a clamping and rotating part of a self-adapting wheel deburring device in the present invention.
Figure 4:
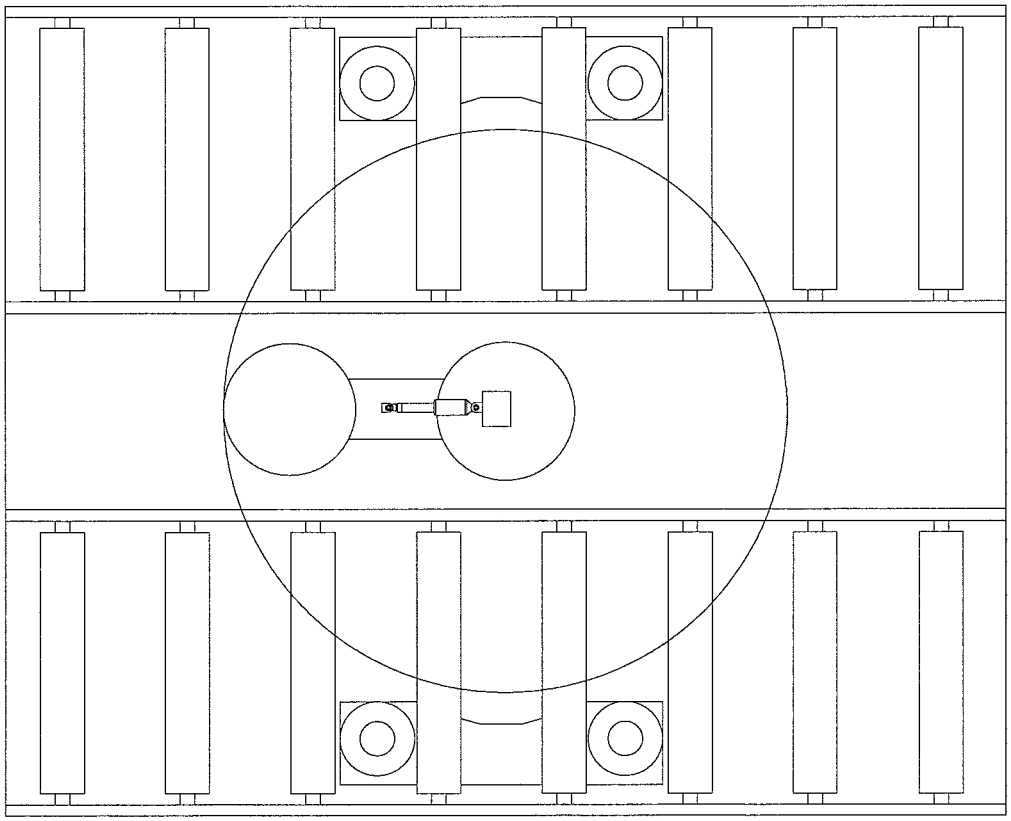
FIG. 4 is a partial top view of a self-adapting wheel deburring device in the present invention.

In the drawings, 1-frame, 2-medium plate, 3-synchronous guide rail, 4-gear rack, 5-left sliding plate, 6-left shaft, 7-left roller, 8-right roller, 9-right shaft, 10-right sliding plate, 11-servo motor, 12-clamping cylinder, 13-gear, 14-lifting cylinder, 15-lower plate, 16-guide post, 17-guide sleeve, 18-lifting plate, 19-translation guide rail, 20-translation bottom plate, 21-upper plate, 22-swing plate I, 23-motor, 24-swing plate II, 25-driving shaft, 26-hairbrush, 27-servo electric cylinder I, 28-upright post, 29-servo electric cylinder II, and 30-servo electric cylinder III.

DETAILED DESCRIPTION

Details and working conditions of a specific device provided by the present invention will be illustrated below in combination with the accompanying drawings.

The device is composed of a frame 1, a medium plate 2, a synchronous guide rail 3, a gear rack 4, a left sliding plate 5, a left shaft 6, a left roller 7, a right roller 8, a right shaft 9, a right sliding plate 10, a servo motor 11, a clamping cylinder 12, a gear 13, a lifting cylinder 14, a lower plate 15, a guide post 16, a guide sleeve 17, a lifting plate 18, a translation guide rail 19, a translation bottom plate 20, an upper plate 21, a swing plate I 22, a motor 23, a swing plate II 24, a driving shaft 25, a hairbrush 26, a servo electric cylinder I 27, an upright post 28, a servo electric cylinder II 29 and a servo electric cylinder III 30. The synchronous guide rail 3 above which the left sliding plate 5 and the right sliding plate 10 are fixed is fixed above the medium plate 2; the gear racks 4 are fixed below both of the left sliding plate 5 and the right sliding plate 10, and two left shafts 6, left rollers 7, right shafts 9 and right rollers 8 are respectively fixed above; the servo motor 11 is installed below the right sliding plate 10; the output end of the clamping cylinder 12 fixed on the right side of the frame 1 is connected with the right sliding plate 10; and the gears 13 engaged with the gear racks 4 are also installed above the medium plate 2 to achieve the synchronous movement of the left sliding plate 5 and the right sliding plate 10.

Two lifting cylinders 14 are fixed below the lower plate 15, and the output ends thereof are hinged with the lifting plate 18 fixed with four guide sleeves 17; the guide posts 16 are fixed between the lower plate 15 and the upper plate 21 and matched with the guide sleeves 17; the translation bottom plate 20 above which the upright post 28 is fixed is fixed above the lifting plate 18 by the translation guide rail 19; the swing plate I 22 is hinged and fixed above the translation bottom plate 20; both ends of the servo electric cylinder II 29 are respectively hinged with the swing plate I 22 and the translation bottom plate 20; the swing plate II 24 is hinged with the swing plate I 22; both ends of the servo electric cylinder I 27 are respectively hinged with the swing plate II 24 and the upright post 28; the motor 23 is fixed below the swing plate II 24, and the output end thereof is connected with the hairbrush 26 by the driving shaft 25; and the output end of the servo electric cylinder III 30 installed above the lifting plate 18 is connected with the upright post 28.

In a working process, a wheel is positioned on a roller way by a sensor, the clamping cylinder 12 drives the two left rollers 7 and the right rollers 8 to clamp the wheel by the gears 13 and the gear racks 4, and the servo motor 11 drives the wheel to rotate at a clamping state; the two lifting cylinders 14 lift the hairbrush 26, and the motor 23 drives the hairbrush 26 to rotate; and the hairbrush 26 can be adjusted to any angle by the servo electric cylinder I 27 and the servo electric cylinder II 29, in order to adapt to the shape of a back cavity of a wheel spoke, and the servo electric cylinder III 30 can adjust the stroke of the hairbrush 26 within a small range.

The invention claimed is:

1. A wheel deburring device, comprising:

a clamping and rotating part comprising a frame, a medium plate, a synchronous guide rail, two gear racks, a left sliding plate, two left shafts, two left rollers, two right rollers, two right shafts, a right sliding plate, a servo motor, a clamping cylinder, and one or more gears; and a burr brushing part comprising a lifting cylinder, a lower plate, a guide post, a guide sleeve, a lifting plate, a translation guide rail, a translation bottom plate, an upper plate, a swing plate I, a motor, a swing plate II, a driving shaft, a hairbrush, a servo electric cylinder I, an upright post, a servo electric cylinder II, and a servo electric cylinder III, wherein the clamping and rotating part is installed on a wheel conveying belt, an advance direction of the wheel conveying belt being perpendicular to a connecting line of the two left rollers and the two right rollers, wherein the burr brushing part is installed in the middle of the conveying belt and below a wheel, and the hairbrush is connected to the servo electric cylinder I and servo electric cylinder II by the swing plate I and the swing plate II, wherein the synchronous guide rail is fixed above the medium plate, the left sliding plate and the right sliding plate are fixed above the synchronous guide rail, the two gear racks are fixed below both of the left sliding plate and the right sliding plate, and the two left shafts, the two left rollers, the two right shafts, and the two right rollers are respectively fixed above their corresponding one of the left sliding plate and the right sliding plate, and the servo motor being installed below the right sliding plate, wherein an output end of the clamping cylinder is connected with one of the right sliding plate and the left sliding plate, the one or more gears are installed above the medium plate, the one or more gears being engaged with the two gear racks to achieve a synchronous movement of the left sliding plate and the right sliding plate, wherein an output end of the lifting cylinder is hinged with the lifting plate that is fixed with the guide sleeve, the guide post is fixed between the lower plate and the upper plate and is matched with the guide sleeve, the translation bottom plate is fixed above the lifting plate by the translation guide rail, and the upright post is fixed above the translation bottom plate, wherein the swing plate I is hinged and fixed above the translation bottom plate, each end of the servo electric cylinder II is hinged with a respective one of the swing plate I and the translation bottom plate, the swing plate II is hinged with the swing plate I, each end of the servo electric cylinder I is hinged with a respective one of the swing plate II and the upright post, the motor is fixed below the swing plate II, an output end of the motor connected with the hairbrush by the driving shaft, the servo electric cylinder III is installed above the lifting plate, and an output end of the servo electric cylinder III being connected with the upright post.

2. A wheel deburring method using the wheel debarring device of claim 1, the method comprising:

utilizing a sensor to position a wheel on the wheel conveying belt, the wheel being positioned such that the clamping cylinder drives, via the one or more gears and the two gear racks, the two left rollers and two right rollers to clamp the wheel.

3. The wheel deburring method of claim 2, further comprising:

adjusting, via the servo electric cylinder I and the servo electric cylinder II, the hairbrush to a particular angle based on a shape of a back cavity of a wheel spoke of the wheel.

4. The wheel deburring method of claim 2, further comprising:

adjusting, via the servo electric cylinder III, a stroke of the hairbrush.

* * * * *